US009737179B2

(12) United States Patent
Fang et al.

(10) Patent No.: US 9,737,179 B2
(45) Date of Patent: Aug. 22, 2017

(54) FACIAL CLEANSING BRUSH STRUCTURE

(71) Applicant: Shen Zhen Cosbeauty Co., Ltd., Shenzhen, Guangdong Province (CN)

(72) Inventors: Ziran Fang, Shenzhen (CN); Wanfu Huang, Shenzhen (CN)

(73) Assignee: Shen Zhen Cosbeauty Co., Ltd. (CN)

( * ) Notice: Subject to any disclaimer, the term of this patent is extended or adjusted under 35 U.S.C. 154(b) by 0 days.

(21) Appl. No.: 15/169,090

(22) Filed: May 31, 2016

(65) Prior Publication Data

US 2017/0086626 A1 Mar. 30, 2017

(30) Foreign Application Priority Data

Sep. 25, 2015 (CN) ..... 2015 2 0750770 U

(51) Int. Cl.
*A46B 13/02* (2006.01)
*A47K 7/04* (2006.01)

(52) U.S. Cl.
CPC ..... *A47K 7/043* (2013.01); *A46B 13/02* (2013.01)

(58) Field of Classification Search
CPC ..... A46B 13/02; A47K 7/043
See application file for complete search history.

(56) References Cited

U.S. PATENT DOCUMENTS 3,346,748 A * 10/1967 McNair ..... H02K 33/04 15/22.1
4,203,431 A * 5/1980 Abura ..... A61H 7/005 15/28
6,575,924 B2 * 6/2003 Wevers ..... A46B 13/00 15/28
2017/0086627 A1 * 3/2017 Fang ..... A46B 13/02

* cited by examiner

*Primary Examiner* — Randall Chin

(57) ABSTRACT

A facial cleansing brush structure includes an outer casing, a brush head assembly, and a brush head drive device. The outer casing has a brush head installation chamber. The brush head assembly includes a brush head and a brush head retaining member. The brush head has an installation base-plate and at least two elastic limit arms. The brush head and the brush head retaining member are skillfully designed to complete the assembly of the brush head and the brush head retaining member. The assembly is simple, easy and stable. On the premise that the facial cleansing brush is small in size, the brush head has a large cleansing area to enhance the cleansing efficiency.

7 Claims, 8 Drawing Sheets

A-A

FACIAL CLEANSING BRUSH STRUCTURE

BACKGROUND OF THE INVENTION

1. Field of the Invention

The present invention relates to a facial cleansing brush, and more particularly to a facial cleansing brush structure.

2. Description of the Prior Art

A conventional facial cleansing brush comprises an outer casing, a brush head assembly, and a brush head drive device. The brush head assembly is connected with and driven by the brush head drive device. The assembly and disassembly of the brush head assembly is complicated. Accordingly, the inventor of the present invention has devoted himself based on his many years of practical experiences to solve these problems.

SUMMARY OF THE INVENTION

In view of this, the present invention is to overcome the shortcomings of the prior art. The primary object of the present invention is to provide a facial cleansing brush structure. A brush head and a brush head retaining member are skillfully designed to complete the assembly of the brush head and the brush head retaining member. The assembly is simple, easy and stable.

In order to achieve the aforesaid object, a facial cleansing brush structure of the present invention comprises an outer casing, a brush head assembly, and a brush head drive device. The outer casing has a brush head installation chamber. The brush head installation chamber is provided with a raised first connecting portion therein for driving a brush head. The brush head assembly comprises the brush head and a brush head retaining member. The brush head retaining member has a positioning baseplate portion, a second connecting portion, and a limit portion for preventing the brush head from disengaging from the brush head retaining member. The second connecting portion is mated with the first connecting portion. The brush head has an installation baseplate for bristles to be set thereon and at least two elastic limit arms to mate with the brush head retaining member. A distal end of each elastic limit arm is formed with a barb portion. The brush head retaining member is located between the two elastic limit arms. The barb portions of the two elastic limit arms are buckled to the limit portion.

Preferably, the positioning baseplate portion of the brush head retaining member is formed with a plurality of positioning holes. The installation baseplate of the brush head is provided with a plurality of positioning posts facing and corresponding to the positioning holes. When the brush head is assembled to the brush head retaining member, the positioning posts are engaged in the positioning holes.

Preferably, the positioning baseplate portion, the second connecting portion, and the limit portion are integrally formed. The second connecting portion extends rearward from a rear end of the positioning baseplate portion. The limit portion extends rearward from the periphery of the positioning baseplate portion to form a cylindrical configuration. Each elastic limit arm is integrally formed with the installation baseplate and extends rearward from a rear end of the installation baseplate. The elastic limit arms are arranged in a circle.

Preferably, an inner wall of the brush head installation chamber is provided with a locking protrusion. An outer periphery of the brush head is provided with a brush head outer ring. An outer wall of the brush head outer ring is formed with a spiral groove. An inner wall of the spiral groove is provided with a raised portion to prevent the brush head outer ring from disengagement. When the brush head outer ring is placed into the brush head installation chamber and turned, the locking protrusion is moved to enter the spiral groove and limited by the raised portion.

Preferably, a noise-isolating rubber ring is provided between the brush head outer ring and the brush head.

Preferably, a circumferential side of a front end of the brush head is provided with a decoration ring. The decoration ring has a front wall and a side wall. An inner wall surface of a rear end of the side wall is provided with a buckle protruding inward. An outer side of the brush head outer ring has an engaging groove. The side wall covers the outer side of the brush head outer ring. The buckle is engaged in the engaging groove. The noise-isolating rubber ring has a front wall, a rear wall, and a connecting wall connected between the front wall and the rear wall. A middle groove is formed between the front wall and the rear wall. A circumferential side of the installation baseplate of the brush head is provided with a flange. The flange is embedded in the middle groove of the noise-isolating rubber ring. The front wall of the noise-isolating rubber ring is located between the front wall of the decoration ring and a front end face of the flange. The rear wall of the noise-isolating rubber ring is located between the brush head outer ring and a rear end face of the flange.

Preferably, the brush head assembly further comprises a shock-absorbing elastic member. One end of the shock-absorbing elastic member leans against the brush head installation chamber, and another end of the shock-absorbing elastic member leans against a rear end of the brush head outer ring.

Compared to the prior art, the present invention has obvious advantages and beneficial effects. The brush head and the brush head retaining member are skillfully designed to complete the assembly of the brush head and the brush head retaining member. The assembly is simple, easy and stable. Besides, the brush head outer ring and the brush head installation chamber are assembled by means of turning. The operation is simple. On the premise that the facial cleansing brush is small in size, the brush head has a large cleansing area to enhance the cleansing efficiency.

DETAILED DESCRIPTION OF THE PREFERRED EMBODIMENTS

Embodiments of the present invention will now be described, by way of example only, with reference to the accompanying drawings.

Figure 1:
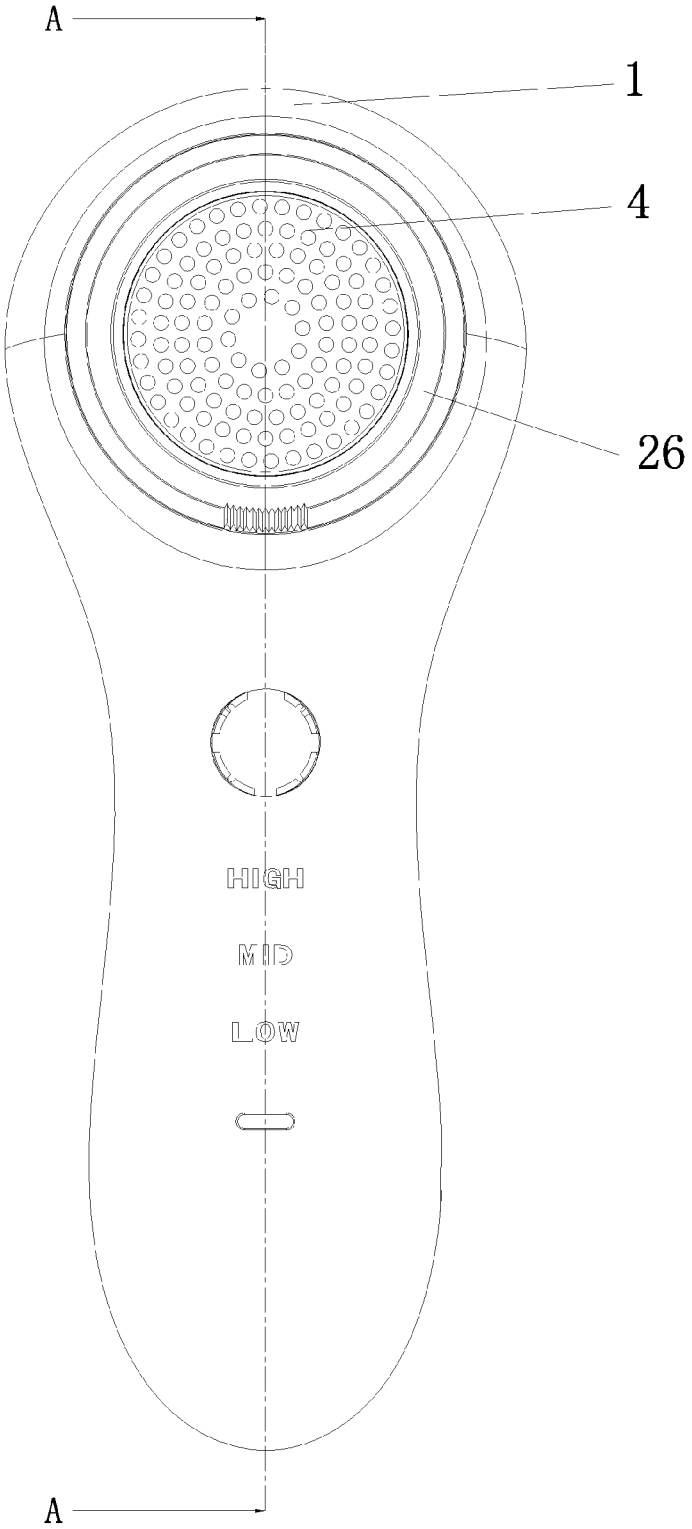
FIG. 1 is a front view in accordance with a preferred embodiment of the present invention.
Figure 2:
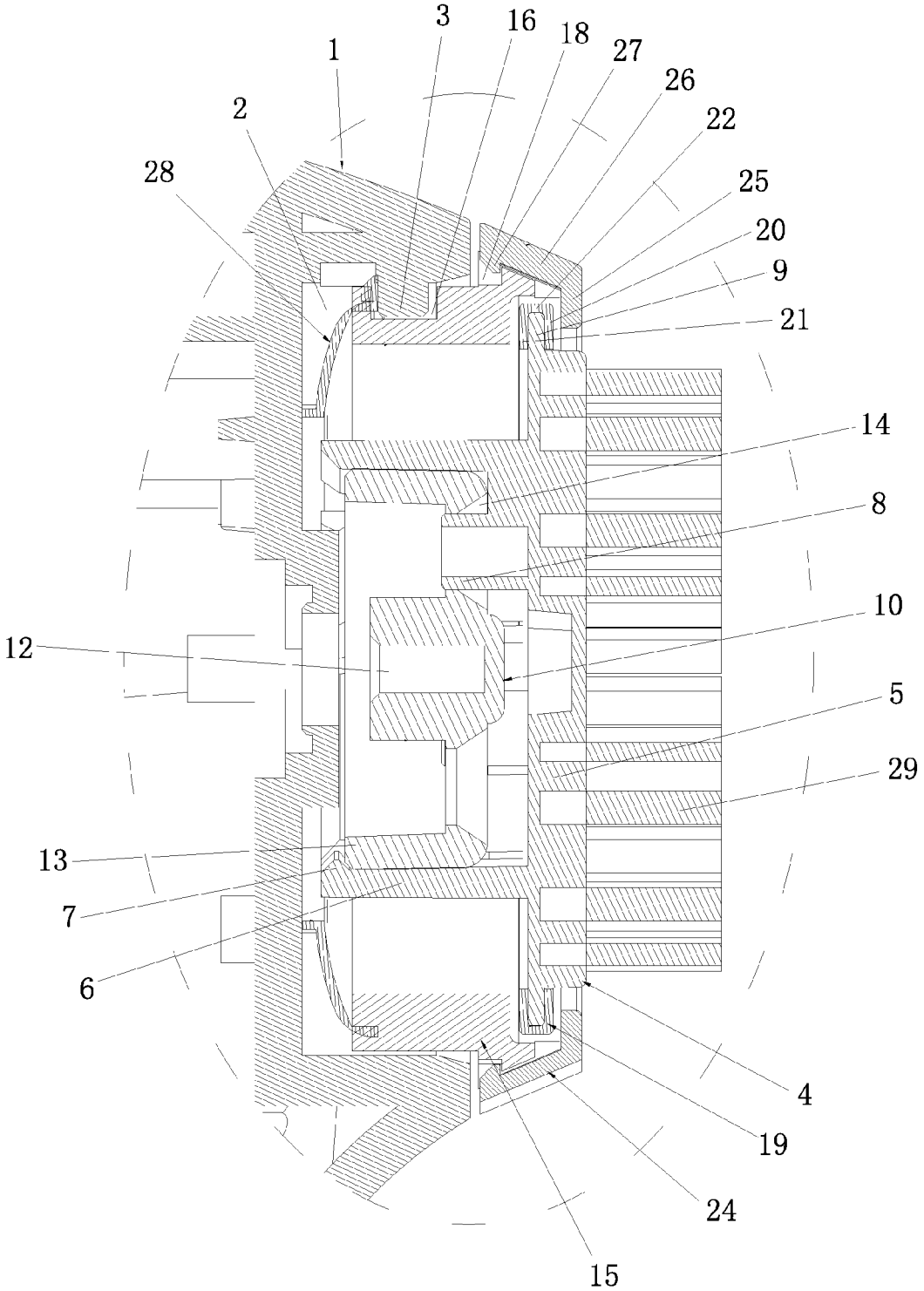
FIG. 2 is a partial sectional view taken along line A-A of FIG. 1.
Figure 3:
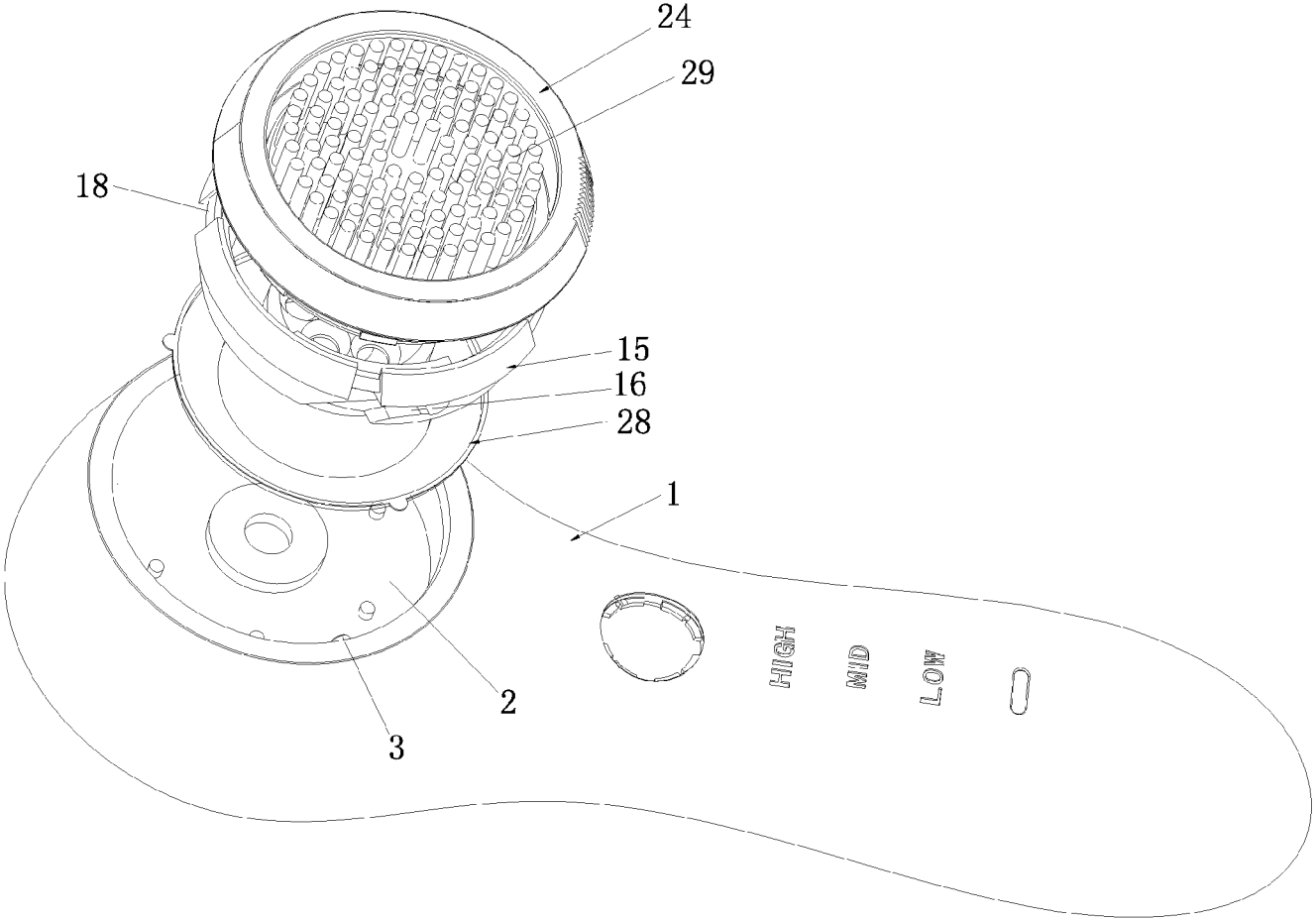
FIG. 3 is a first exploded view in accordance with the preferred embodiment of the present invention.
Figure 4:
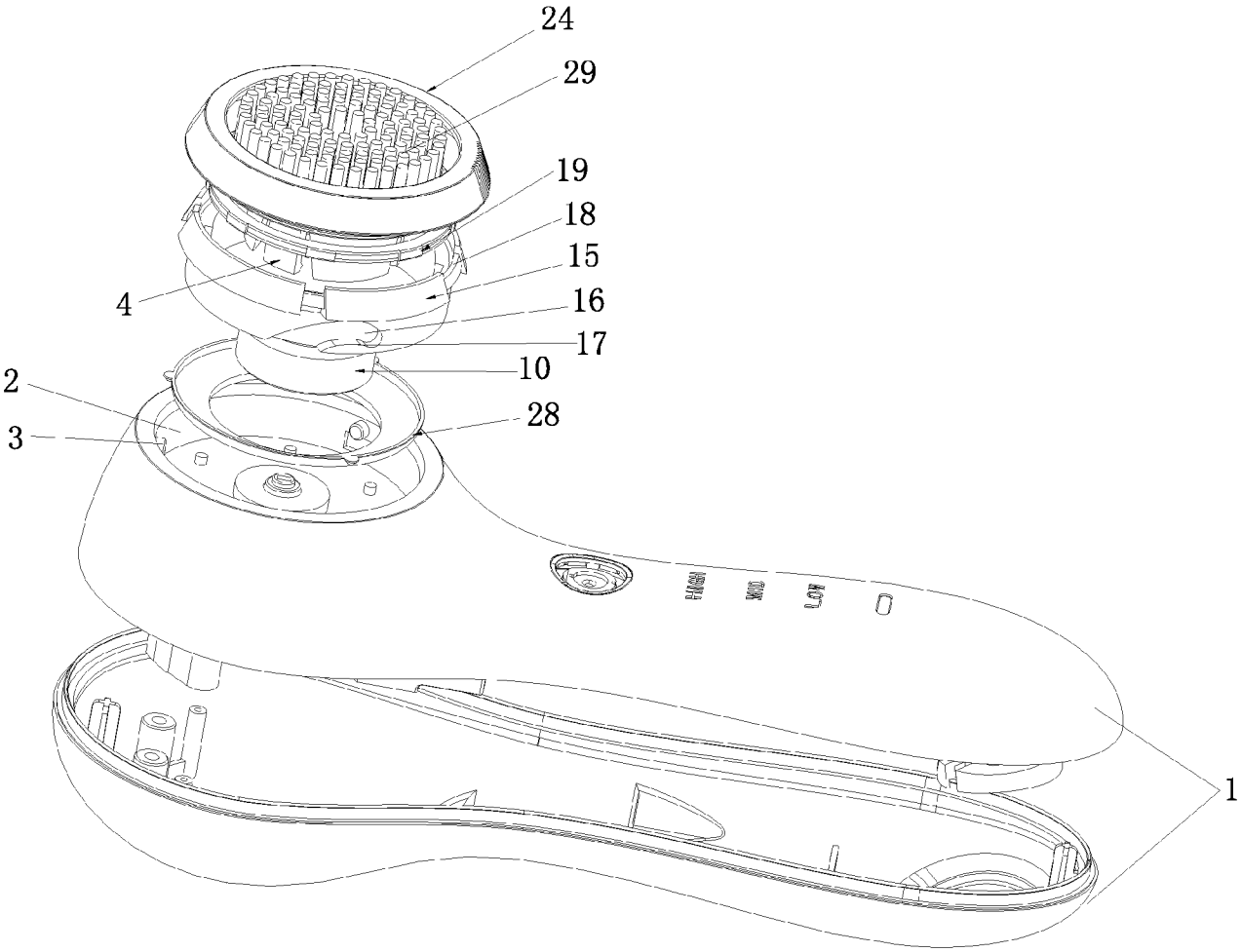
FIG. 4 is a second exploded view in accordance with the preferred embodiment of the present invention.
Figure 5:
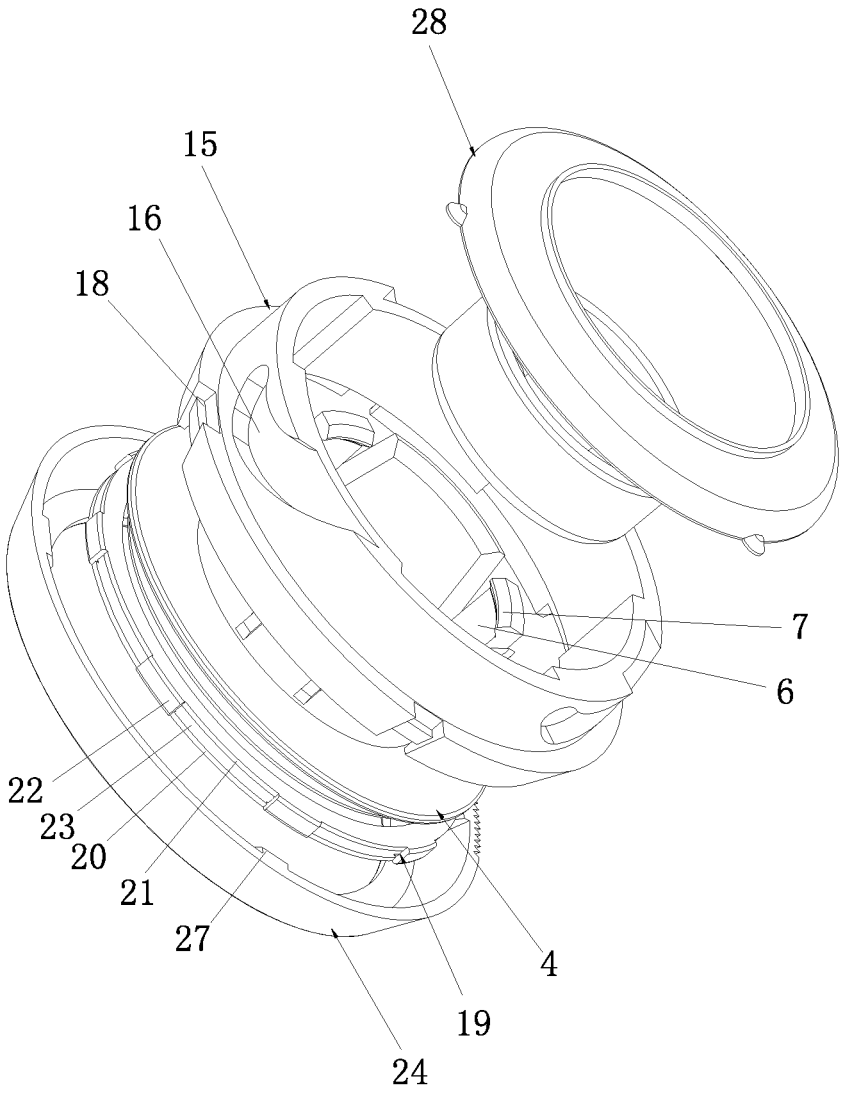
FIG. 5 is a first exploded view of the brush head assembly in accordance with the preferred embodiment of the present invention.
Figure 6:
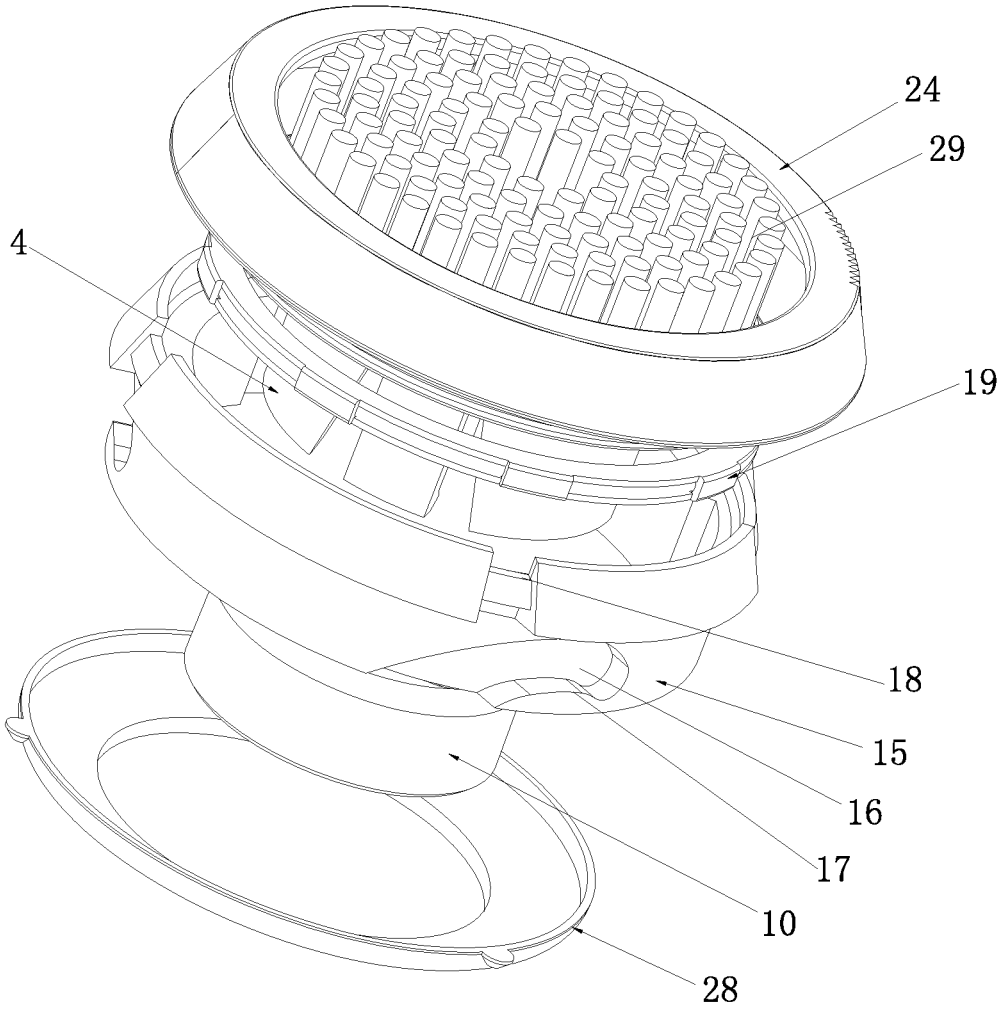
FIG. 6 is a second exploded view of the brush head assembly in accordance with the preferred embodiment of the present invention.
Figure 7:
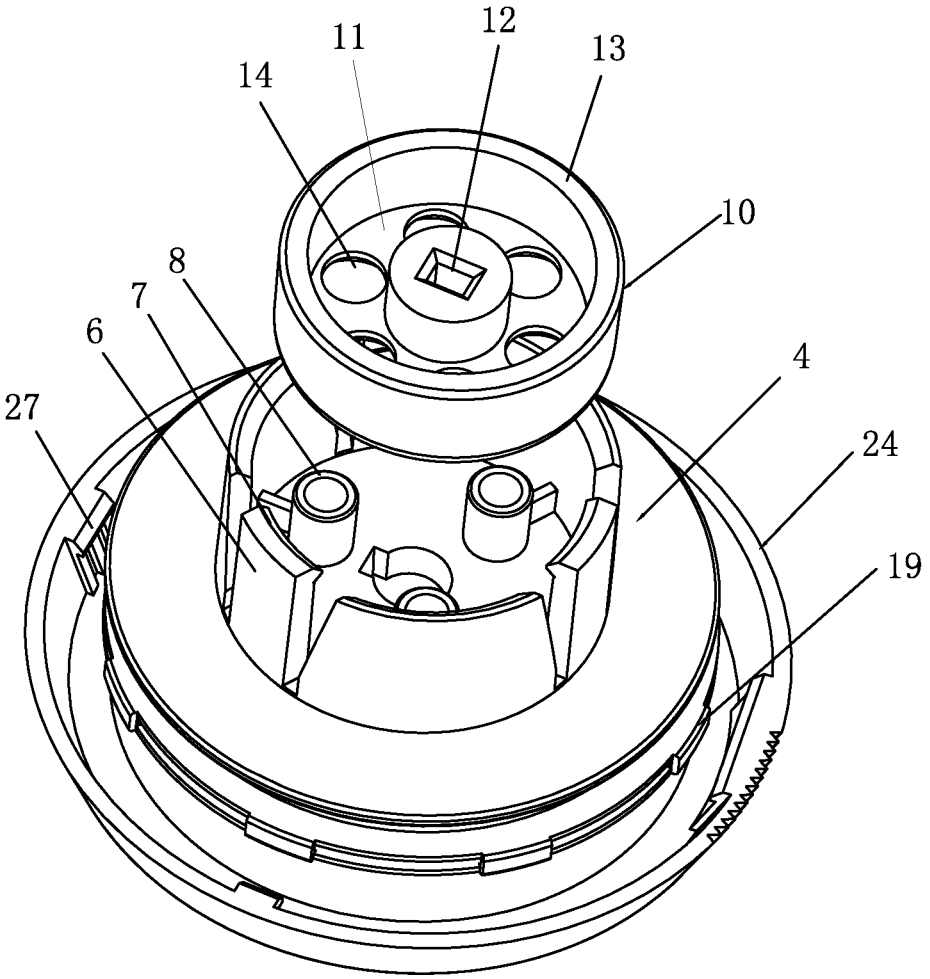
FIG. 7 is a third exploded view of the brush head assembly in accordance with the preferred embodiment of the present invention.
Figure 8:
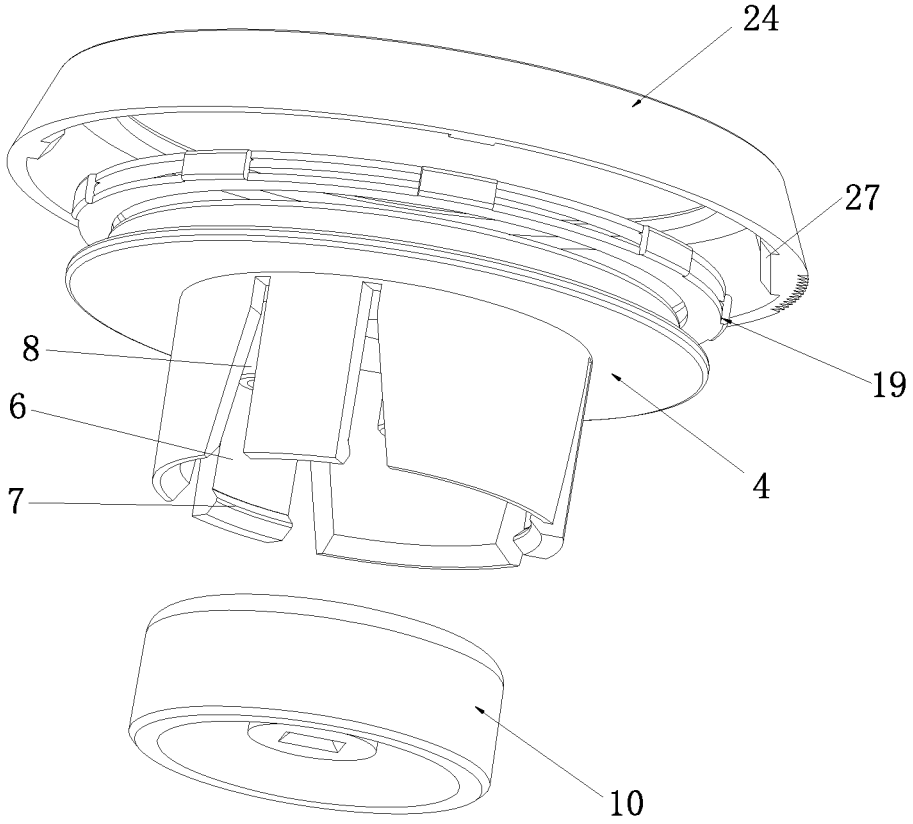
FIG. 8 is a fourth exploded view of the brush head assembly in accordance with the preferred embodiment of the present invention.

As shown in FIG. 1 through FIG. 8, a facial cleansing brush structure in accordance with a preferred embodiment of the present invention comprises an outer casing 1, a brush head assembly, and a brush head drive device. The outer casing 1 has a brush head installation chamber 2. The brush head installation chamber 2 is provided with a raised first connecting portion therein for driving a brush head. The first connecting portion is connected with the brush head drive device.

The brush head assembly comprises a brush head 4, a brush head retaining member 10, a shock-absorbing elastic member 28, a noise-isolating rubber ring 19, and a brush head outer ring 15.

The brush head 4 has an installation baseplate 5 for bristles 29 to be set thereon and at least two elastic limit arms 6 to mate with the brush head retaining member 10. A distal end of each elastic limit arm 6 is formed with a barb portion 7. In this embodiment, each elastic limit arm 6 is integrally formed with the installation baseplate 5 and extends rearward from a rear end of the installation baseplate 5. The elastic limit arms 6 are arranged in a circle.

The brush head retaining member 10 has a positioning baseplate portion 11, a second connecting portion 12, and a limit portion 13 for preventing the brush head 4 from disengaging from the brush head retaining member 10. The positioning baseplate portion 11 of the brush head retaining member 10 is formed with a plurality of positioning holes 14. The installation baseplate 5 of the brush head 4 is provided with a plurality of positioning posts 8 facing and corresponding to the positioning holes 14. When the brush head 4 is assembled to the brush head retaining member 10, the positioning posts 8 are engaged in the positioning holes 14. The second connecting portion 12 is mated with the first connecting portion. The brush head retaining member 10 is located between the two elastic limit arms 6. The barb portions 7 of the two elastic limit arms 6 are buckled to the limit portion 13. In this embodiment, the positioning baseplate portion 11, the second connecting portion 12, and the limit portion 13 are integrally formed. The second connecting portion 12 extends rearward from a rear end of the positioning baseplate portion 11. The limit portion 13 extends rearward from the periphery of the positioning baseplate portion 11 to form a cylindrical configuration.

An outer wall of the brush head outer ring 15 is formed with a spiral groove 16. An inner wall of the spiral groove 16 is provided with a raised portion 17 to prevent the brush head outer ring 15 from disengagement. An inner wall of the brush head installation chamber 2 is provided with a locking protrusion 3. When the brush head outer ring 15 is placed into the brush head installation chamber 2 and turned, the locking protrusion 3 is moved to enter the spiral groove 16 and limited by the raised portion 17.

One end of the shock-absorbing elastic member 28 leans against the brush head installation chamber 2, and another end of the shock-absorbing elastic member 28 leans against a rear end of the brush head outer ring 15. In this embodiment, the shock-absorbing elastic member 28 is substantially an annular curved plate. The cross-section of the shock-absorbing elastic member 28 is gradually enlarged to be a trumpet-shaped configuration. The outer edge of the front end of the shock-absorbing elastic member 28 is provided with a plurality of support points to get in contact with the brush head outer ring 15.

The noise-isolating rubber ring 19 is disposed between the brush head outer ring 15 and the brush head 4. The noise-isolating rubber ring 19 has a front wall 20, a rear wall 21, and a connecting wall 22 connected between the front wall 20 and the rear wall 21. A middle groove 23 is formed between the front wall 20 and the rear wall 21. A circumferential side of the installation baseplate 5 of the brush head 4 is provided with a flange 9. The flange 9 is embedded in the middle groove 23 of the noise-isolating rubber ring 19. A circumferential side of the front end of the brush head 4 is provided with a decoration ring 24. The decoration ring 24 has a front wall 25 and a side wall 26. An inner wall surface of a rear end of the side wall 26 is provided with a buckle 27 protruding inward. An outer side of the brush head outer ring 15 has an engaging groove 18. The side wall 26 covers the outer side of the brush head outer ring 15. The buckle 27 is engaged in the engaging groove 18. The front wall 20 of the noise-isolating rubber ring 19 is located between the front wall 25 of the decoration ring 24 and a front end face of the flange 9. The rear wall 21 of the noise-isolating rubber ring 19 is located between the brush head outer ring 15 and a rear end face of the flange 9.

The feature of the present invention is that the brush head and the brush head retaining member are skillfully designed to complete the assembly of the brush head and the brush head retaining member. The assembly is simple, easy and stable. Besides, the brush head outer ring and the brush head installation chamber are assembled by means of turning. The operation is simple. On the premise that the facial cleansing brush is small in size, the brush head has a large cleansing area to enhance the cleansing efficiency.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A facial cleansing brush structure, comprising an outer casing, a brush head assembly, and a brush head drive device; the outer casing having a brush head installation chamber, the brush head installation chamber being provided with a raised first connecting portion therein for driving a brush head; the brush head assembly comprising the brush head and a brush head retaining member, the brush head retaining member having a positioning baseplate portion, a second connecting portion, and a limit portion for preventing the brush head from disengaging from the brush head retaining member; the second connecting portion being mated with the first connecting portion; the brush head having an installation baseplate for bristles to be set thereon and at least two elastic limit arms to mate with the brush head retaining member, a distal end of each elastic limit arm being formed with a barb portion; the brush head retaining member being located between the two elastic limit arms, the barb portions of the two elastic limit arms being buckled to the limit portion.

2. The facial cleansing brush structure as claimed in claim 1, wherein the positioning baseplate portion of the brush head retaining member is formed with a plurality of positioning holes, the installation baseplate of the brush head is provided with a plurality of positioning posts facing and corresponding to the positioning holes, when the brush head is assembled to the brush head retaining member, the positioning posts are engaged in the positioning holes.

3. The facial cleansing brush structure as claimed in claim 2, wherein the positioning baseplate portion, the second connecting portion, and the limit portion are integrally formed, the second connecting portion extends rearward from a rear end of the positioning baseplate portion, the limit portion extends rearward from a periphery of the positioning baseplate portion to form a cylindrical configuration; each elastic limit arm is integrally formed with the installation baseplate and extends rearward from a rear end of the installation baseplate, and the elastic limit arms are arranged in a circle.

4. The facial cleansing brush structure as claimed in claim 1, wherein an inner wall of the brush head installation chamber is provided with a locking protrusion, an outer periphery of the brush head is provided with a brush head outer ring, an outer wall of the brush head outer ring is formed with a spiral groove, an inner wall of the spiral groove is provided with a raised portion to prevent the brush head outer ring from disengagement, when the brush head outer ring is placed into the brush head installation chamber and turned, the locking protrusion is moved to enter the spiral groove and limited by the raised portion.

5. The facial cleansing brush structure as claimed in claim 4, wherein a noise-isolating rubber ring is provided between the brush head outer ring and the brush head.

6. The facial cleansing brush structure as claimed in claim 5, wherein a circumferential side of a front end of the brush head is provided with a decoration ring, the decoration ring has a front wall and a side wall, an inner wall surface of a rear end of the side wall is provided with a buckle protruding inward, an outer side of the brush head outer ring has an engaging groove, the side wall covers the outer side of the brush head outer ring, the buckle is engaged in the engaging groove; the noise-isolating rubber ring has a front wall, a rear wall, and a connecting wall connected between the front wall and the rear wall, a middle groove is formed between the front wall and the rear wall, a circumferential side of the installation baseplate of the brush head is provided with a flange, the flange is embedded in the middle groove of the noise-isolating rubber ring, the front wall of the noise-isolating rubber ring is located between the front wall of the decoration ring and a front end face of the flange, and the rear wall of the noise-isolating rubber ring is located between the brush head outer ring and a rear end face of the flange.

7. The facial cleansing brush structure as claimed in claim 4, wherein the brush head assembly further comprises a shock-absorbing elastic member, one end of the shock-absorbing elastic member leans against the brush head installation chamber, and another end of the shock-absorbing elastic member leans against a rear end of the brush head outer ring.

* * * * *